US008024882B2

(12) United States Patent
Kelley

(10) Patent No.: US 8,024,882 B2
(45) Date of Patent: Sep. 27, 2011

(54) MACHINE-PRINTABLE, POP-OUT TABBED INDEXED DIVIDERS

(75) Inventor: John Falk Kelley, Clarkesville, GA (US)

(73) Assignee: International Business Machines Corporation, Armonk, NY (US)

( * ) Notice: Subject to any disclaimer, the term of this patent is extended or adjusted under 35 U.S.C. 154(b) by 23 days.

(21) Appl. No.: 12/355,306

(22) Filed: Jan. 16, 2009

(65) Prior Publication Data

US 2010/0183358 A1 Jul. 22, 2010

(51) Int. Cl.
*G09F 23/10* (2006.01)

(52) U.S. Cl. ..... 40/641; 40/360; 283/41

(58) Field of Classification Search ..... 40/641, 40/360; 283/37, 41, 36; 402/79
See application file for complete search history.

(56) References Cited

U.S. PATENT DOCUMENTS

| | | | | |
|---|---|---|---|---|
| 2,300,623 | A * | 11/1942 | Hornung | 40/360 |
| 4,184,699 | A * | 1/1980 | Lowe, Jr. | 281/41 |
| 5,540,513 | A * | 7/1996 | Wyant | 402/79 |
| 6,132,831 | A | 10/2000 | Thomas-Cote | |
| 6,328,338 | B1 * | 12/2001 | Sherman et al. | 281/42 |
| 6,352,287 | B2 * | 3/2002 | Casagrande | 283/81 |
| 6,549,300 | B2 | 4/2003 | Motamed et al. | |
| 7,373,749 | B1 * | 5/2008 | Lewis | 40/673 |
| 7,553,270 | B2 * | 6/2009 | Rasmussen | 493/356 |
| 2006/0076771 | A1 * | 4/2006 | Schafer | 283/36 |
| 2006/0291003 | A1 | 12/2006 | Sklenar | |

FOREIGN PATENT DOCUMENTS

| | | | |
|---|---|---|---|
| GB | 2198692 | A * | 6/1988 |
| JP | 2006335056 | A * | 12/2006 |
| WO | WO 2006128943 | A1 * | 12/2006 |

* cited by examiner

*Primary Examiner* — Cassandra Davis
(74) *Attorney, Agent, or Firm* — Karuna Ojanen; Ojanen Law Offices

(57) ABSTRACT

A machine-printable sheet material having pop-out index tabs. The index tabs have a printable region on a face of the sheet material opposite from the face from which the index tabs will pop-out. Each index tab is perforated along its perimeter except at a fold line. The index tab is rotatable at the fold line when it pops out. Each index tab has ears that are insertible into slits positioned from the edge of the sheet material such that when the ears are inserted into and engaged with the slits, the printable region extends from the edge of the sheet material to provide an index tab.

7 Claims, 6 Drawing Sheets

MACHINE-PRINTABLE, POP-OUT TABBED INDEXED DIVIDERS

FIELD OF THE INVENTION

The invention relates generally to a machine-printable index tab assembly having a divider sheet material for use in notebooks, binders and the like to separate sections and further relates to sheet materials having index tabs wherein the index tabs can be printed in a desktop or commercial printer. After printing, the index tabs are folded to extend beyond the edge of the sheet material.

BACKGROUND

When printed material is contained in notebooks or binders where pages can be inserted and removed, the printed material is often separated into sections by the use of indexed tabbed dividers. These dividers are usually of a heavier weight divider sheet material and have index tabs extending beyond the edges of the divider sheet material at several locations along an edge of the sheet. The difficulty of using indexed tabbed dividers today, however, is that these indexed tabbed dividers cannot be conveniently inserted into a standard inkjet or laser printer connected to a computer for printing using a word processing program. The index tab is outside the "printable area." To be able to use the indexed tabbed dividers, sheets having removable labels for the index tabs can be printed, then the index tabs or labels are removed from a carrier sheet and placed onto the dividers by a user, such as described in U.S. Pat. No. 6,132,831 entitled Computer Printer Compatible Index TABS to Thomas-Cote. Another solution uses pre-numbered or prelabeled index tabs. An index table of contents or an index page is printed with sections labeled according to the labels on the index tabs. This approach is not very user-friendly because a user must flip back and forth between the table of contents and/or index to determine the section to which the preprinted number or letter refers.

What is desirable is to be able to print directly onto the indexed tabbed divider using standard laser jets and ink jet printers.

SUMMARY OF THE INVENTION

According to one embodiment of the present invention, a machine-printable index tab assembly is provided having a sheet material; one or more pop-out index tabs integral with the sheet material, each index tab having a fold, each index tab perforated along its perimeter except at the fold, each index tab having a printable region opposite the fold, each index tab having at least one ear extending away from an edge perpendicular to the fold; and at least one slit in and positioned near an edge of the sheet material, each slit corresponding to and substantially a same length as the at least one ear; wherein the pop-out index tab is separable from the sheet material except at the fold and is rotatable along the fold and an ear is insertible into its respective slit, and the printable region is extensible beyond the edge of the sheet material as an index tab.

A carrier layer may be attached to a side of the sheet material opposite to a side from which the one or more index tabs will pop-out. The index tabs may be equally spaced along a dimension of the sheet material, or the index tabs may be in a staggered arrangement on the sheet material.

Also disclosed herein is a computer program product having computer program instructions on a computer-readable medium such that when the computer program instructions are installed in a computer memory cause the computer to display an image of a sheet material having an image of an arrangement of pop-out printable index tabs on the sheet material, request a user to input a selection of one or more of the printable index tabs; request a user to enter alphanumeric text to print on the one or more printable index tabs; and send instructions to a printer to print the alphanumeric text on the one or more printable index tabs. The user may be asked to select an orientation of the text on the index tab and the computer program will display the alphanumeric text properly oriented on a visual display. The user is provided with the capability to change print options. The computer program may also provide instructions to the user for placement of the sheet material in the printer.

DETAILED DESCRIPTION OF THE SEVERAL EMBODIMENTS

Figure 1:
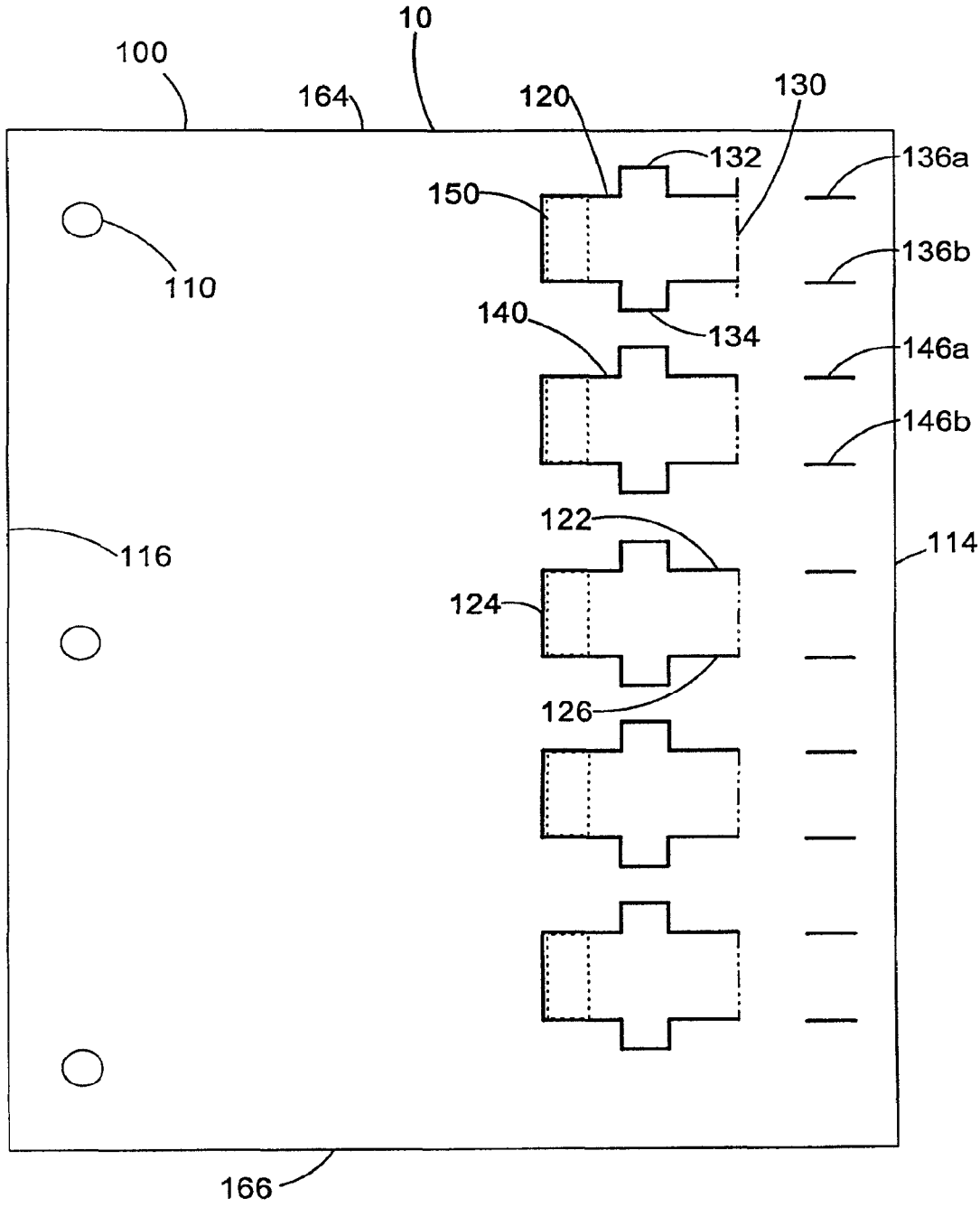
FIG. 1 an illustration of an embodiment of divider sheet material having printable index pop-out index tabs. It is suggested that FIG. 1 be printed on the face of the patent.

With reference to FIG. 1, there is shown a machine-printable index tab assembly 10 that comprises a divider sheet material 100. Divider sheet material 100 is preferably of a durable and sufficient weight to be noticeably different than the sheets that will be separated by the divider sheet material 100. The machine-printable index tab assembly 10 and more particularly the divider sheet material 100 is preferably printable in commercial and personal printers, including but not limited to laser, ink-jet, or impact printers. Of course, although the index tab assembly is machine-printable, one of skill in the art will easily acknowledge that the index tabs can also be hand-printed. Examples of suitable divider sheet material 100 may be paper cardstock, plastic, or a printable polymer. The divider sheet material 100 of the machine-printable index tab assembly 10 may actually comprise one or more layers such that the index tabs 120 are on one layer and there may be a carrier layer 330 in FIG. 3B attached to and integral with the divider sheet material 100 such that the index tabs 120 are releasable from the carrier layer 330. Using a carrier layer 330 can provide greater durability to the divider sheet material 100 after the index tabs 120 have been deployed. The divider sheet material 100 is generally rectangular and is preferably of the same size as the sheets that it will separate, such as, for example, 8½×11 inches, 11×17 inches, or A4 paper. Preferably the size of the divider sheet material 100 is a standard size that fits in most commercial and personal printers for batch printing without having to reprogram the printer or the printer drivers when the printer is electronically or wirelessly connected to a computer. Optional punched holes 110 are shown in the divider sheet material 100 so that the dividers 100 can be inserted into, for instance, a 3-ring binder or notebook. Holes 110 need not be located along the left side of the divider sheet material but may be located near any edge. Of course, there may be fewer or more holes 110 or none at all as when the divider sheet material 100 is used in, for instance, a punchless clamp binder. Divider sheet material 100 has four edges: a right edge 114, a left edge 116, a top edge 164, and a bottom edge 166; as shown in FIG. 1 the face of the divider sheet material 100 towards the viewer is the obverse side and the face of the divider sheet material 100 that cannot be seen facing downwards away the viewer is the reverse side.

Index tabs 120 are formed in the divider sheet material 100 and can be made of a heavier or stronger or more durable material than the divider sheet material 100; alternatively, the divider sheet material 100 may be reinforced with a polymer or other stronger material in the location of the index tabs 120. The index tabs 120 shown in FIG. 1 are equally spaced along a vertical direction of the divider sheet material 100. This is not to be taken as a limitation of the embodiments described herein. There may be more or fewer index tabs 120. Index tabs 120 may be located nearer to any edge of the divider sheet material 120. Index tabs 120 may be larger or smaller than illustrated. Index tabs 120 need not be equally spaced along a dimension of the divider sheet material 100.

Each index tab 120 is die-cut or scored on its perimeter at those edges 122, 124, and 126 that are not at the fold 130 so that those edges are releasable from the divider sheet material 100, i.e., those edges of the index tab 120 can be separated to pop-out of the plane of divider sheet material 100. The index tab 120 has a fold 130 that is scored or impressed so that the index tab 120 can be easily folded but remain integral with and attached to the divider sheet material 100. When deployed, the index tab 120 is released or popped-out of the plane of the divider sheet material 100 and folded at fold 130 so that index tab 120 extends in an opposite direction from its original position in the divider sheet material 120. When deployed in this matter, the index tab 120 extends beyond the edge 114 of the divider sheet material 120 as shown in FIGS. 2A, 2B and 3A, 3B.

Returning to FIG. 1, each index tab 120 has a printable region 150 opposite the fold 130 and at or near the edge 124. Printable region 150 may be of a different material in density, weight, print quality from the rest of the divider sheet material 100 and even from the rest of the index tab 120 so that the print may be of higher quality, permanent, and/or for durability during use. As shown in FIG. 1, the divider sheet material 100 can be printed on the reverse face of the divider sheet material 100 so that when the index tab 120 is deployed, the printing becomes obverse, as in FIGS. 2A and 2B. Alternatively, when printing is done on the obverse side of the divider sheet material 100, the index tabs 120 are popped-out and engaged, and the divider sheet material 100 is simply flipped at edge 164 or edge 166 so that when flipped, the edge 164 is at the bottom of the view, as in FIGS. 3A and 3B. The printable region 150 is that portion of the index tab 120 that extends from the edge 114 of the divider sheet material 100 and so is exposed to handling and environmental conditions.

Figure 2A:
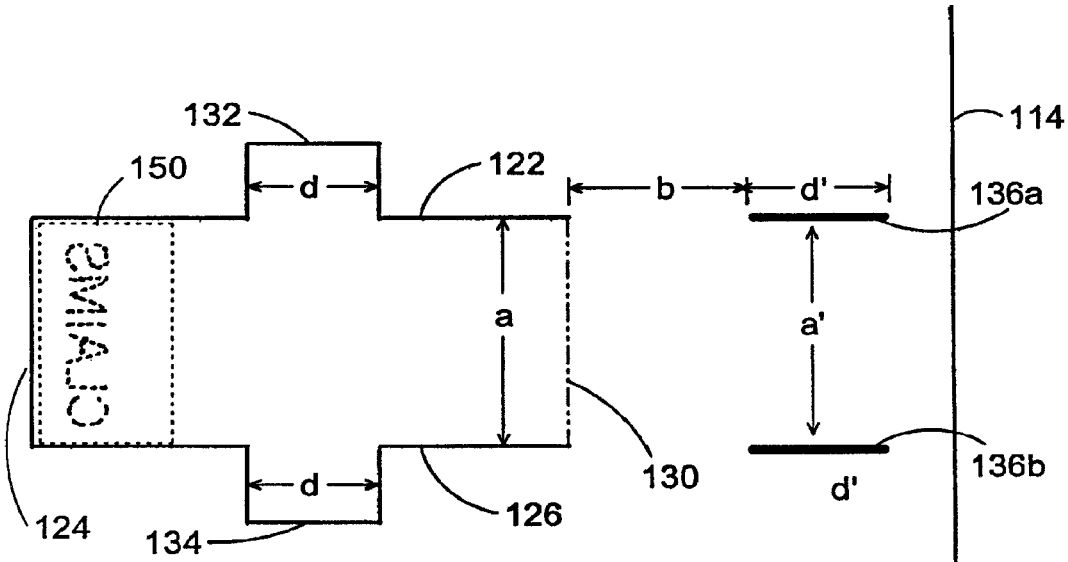
FIGS. 2A and 2B are enlarged illustrations of deployment of the printable index pop-out index tabs of the embodiment of FIG. 1.
Figure 2B:
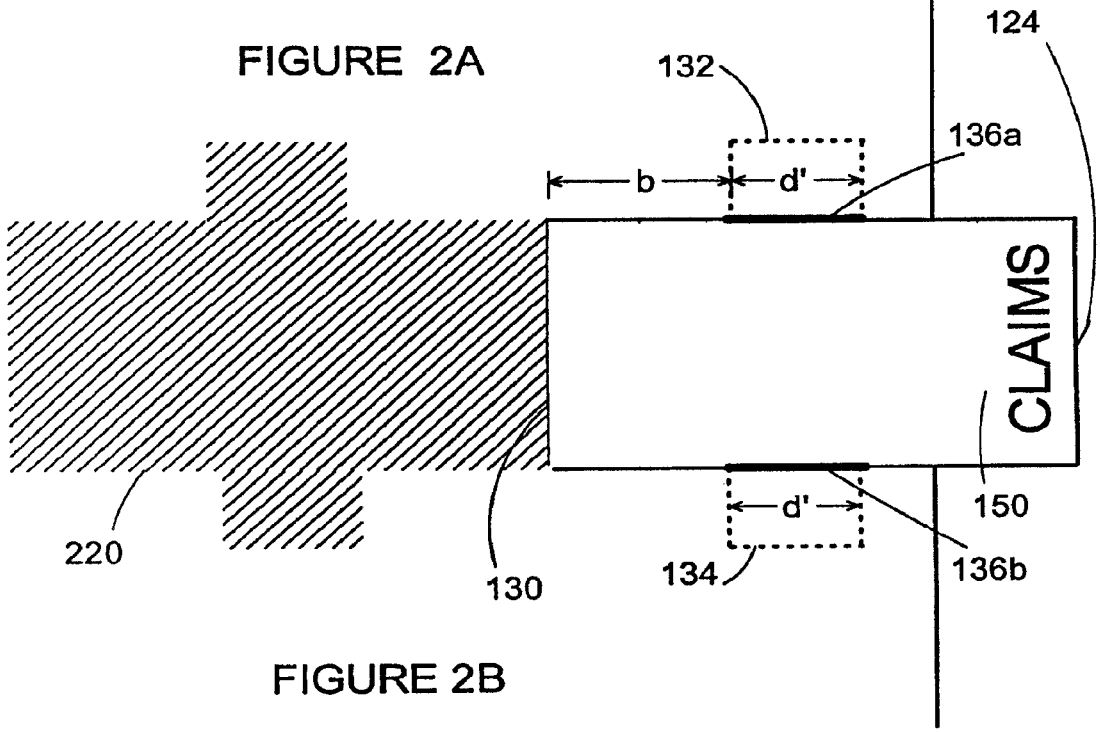

With reference to FIGS. 2A and 2B, each index tab 120 has one or more generally rectangular shaped flaps or ears 132, 134 extending from the index tab edges 122, 126 perpendicular to the fold 130. Two ears 132, 134 are shown, one ear 132 extending upward from the upper horizontal edge 122 of the index tab 120 and one ear 134 extending downward from the lower horizontal edge 126 of the index tab 120. Ears 132, 134 can also be of the same material as the divider sheet material 100. Ears 132, 134 can be reinforced, similar to printable region 150. More ears can be implemented on either or both horizontal edges of the index tab. These ears are used during the deployment of the index tabs 120.

Viewing FIGS. 1, 2A and 2B together, near the edge 114 of the divider sheet material 100 from which index tabs 120 extend are perforations or slits 136*a* and 136*b* and perforations or slits 146*a* and 146*b* for index tab 140. Each slit 136*a* and 136*b* has a dimension d' that is the same length or minutely longer, e.g., one millimeter, than a length d of corresponding ear 132, 134. Each slit 136*a*, 136*b* begins at a distance b from the fold 130 that is a same distance that the right edge of ear 132, 134 is from the fold 130 in an opposite direction. Slits 136*a*, 136*b* come in pairs when there are two ears 132, 134. The vertical distance a' between the slits 136*a*, 136*b* is the same distance or minutely larger than the distance a between edge 122 and edge 126 at the ears 132, 134. The periphery of each slit 136*a* and 136*b* may be reinforced on one or both sides of its opening. During deployment, the index tab 120 is popped-out or separated from the plane of the divider sheet material 100, is folded at fold 130 wherein a user will tuck ear 132 into slit 136*a* and tuck ear 134 into slit 136*b* so that printable region 150 is obverse and the printable region 150 and edge 124 extend beyond the edge 114 of the divider sheet material 100. Of course, if there are more ears 132, 134 there would be more slits or perforations 136*a*, 136*b* an equidistant opposite from the fold 130 and of substantially same length as the horizontal dimension of the respective ear. In this fashion, the ears 132, 134 engage with the slits 136*a*, 136*b* to secure the index tabs 120 while deployed, i.e., while the index tabs 120 extend from the edge 114 of the divider sheet material 100.

A carrier layer 330 is useful after the index tab 120 is deployed. Without a carrier layer 330, there would be a void 220 in the divider sheet material 100 when the index tab 120 is deployed. These voids can result in weakening of the divider sheet material 100 that could easily tear, depending upon the divider sheet material 100. Thus, the carrier layer 330 provides reinforcement of the divider sheet material 100 after the index tabs 120 have been deployed. If the divider sheet material 100 has a carrier layer 330, the carrier layer 330 can have an opening 340 shown in FIG. 3C to expose the printable region 150 for printing on the reverse side. This printable region opening 340, however, is much smaller that the void resulting from deployment of the index tabs 120 without a carrier layer 330. When printing on the obverse side, however, the carrier layer 330 need not have any opening.

Figure 3A:
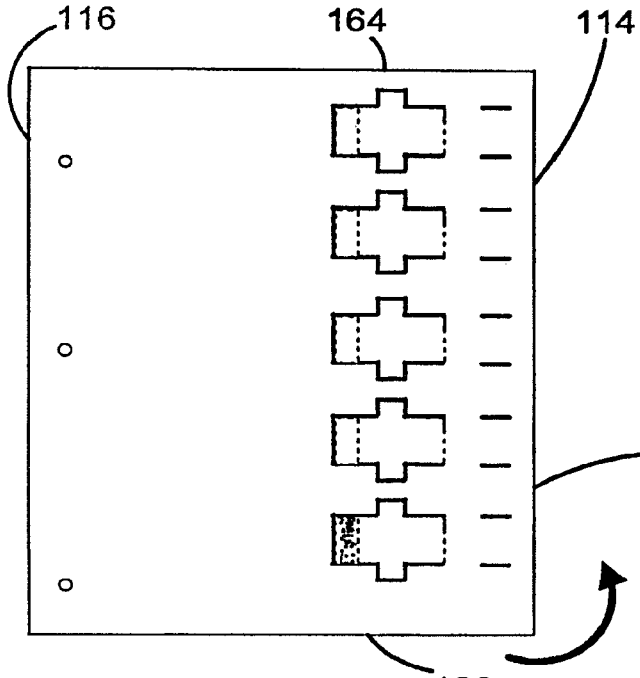
FIGS. 3A and 3B illustrate the divider sheet material when printing is done on the obverse of the divider sheet material and when the printed index tab is deployed.
Figure 3B:
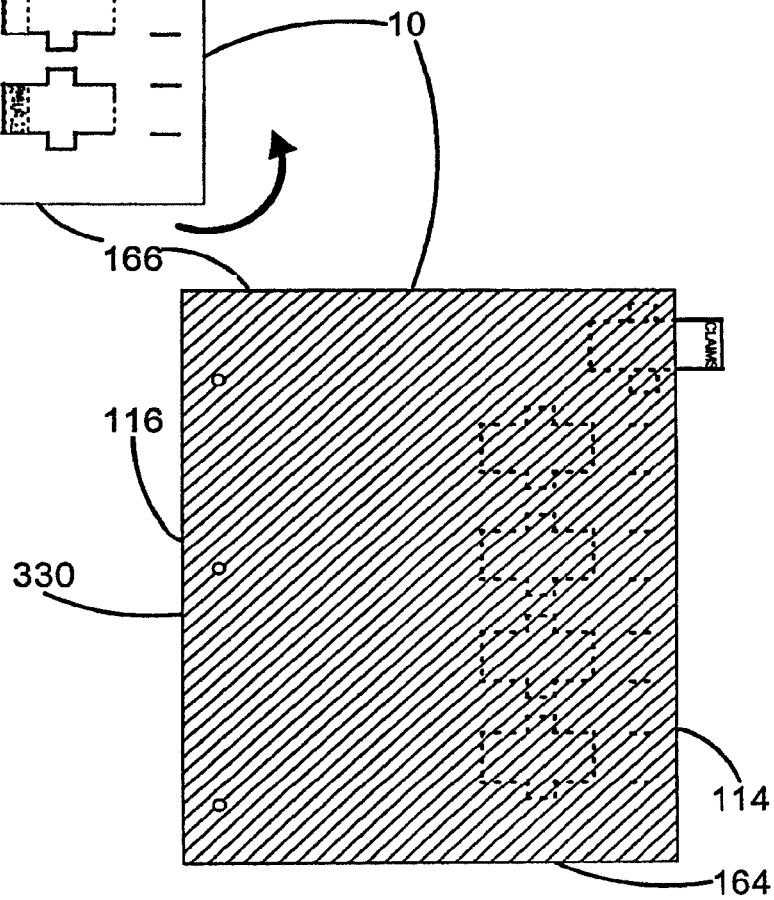
Figure 3C:
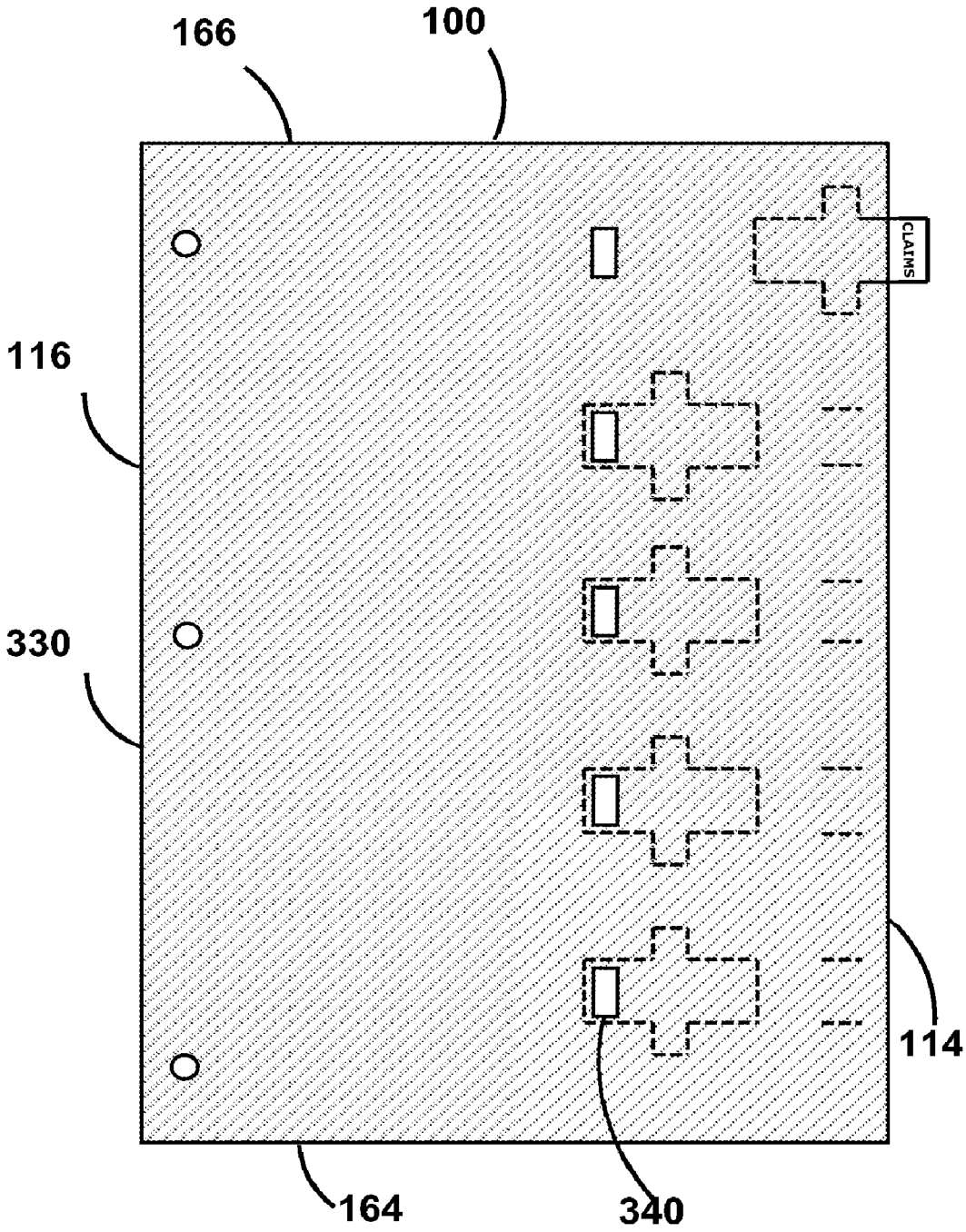
FIG. 3C illustrates the carrier layer having an opening as the printable region.

FIGS. 3A and 3B illustrate the deployment of the lower printed index tab 120 from the divider sheet material 100 of FIG. 1 when printed on the obverse side. After printed in the printed region 150, the index tab is deployed as shown in FIG. 2B and at this point the print on printed region 150 will face towards the direction of the reverse side of the divider sheet material 100. As shown in FIG. 3B, when the divider sheet material 110 is flipped or rotated at edge 166, however, the printed index tab 120 will extend from the reverse side of the printed sheet material 100 and the printed region 150 will be obverse. Carrier layer 330 is now obverse when the divider sheet material 100 is flipped. One or more or none of the index tabs 120 can be deployed in any of the divider sheet material 100. The printed index tabs 120 in the Figures preferably are equally spaced along a vertical dimension of the divider sheet material 100 but the index tabs 120 need not be equally spaced along a dimension. Equal spacing of the index tabs 120, however, is more pleasing to a person using the notebook or binder employing the divider sheet material 100.

Figure 4:
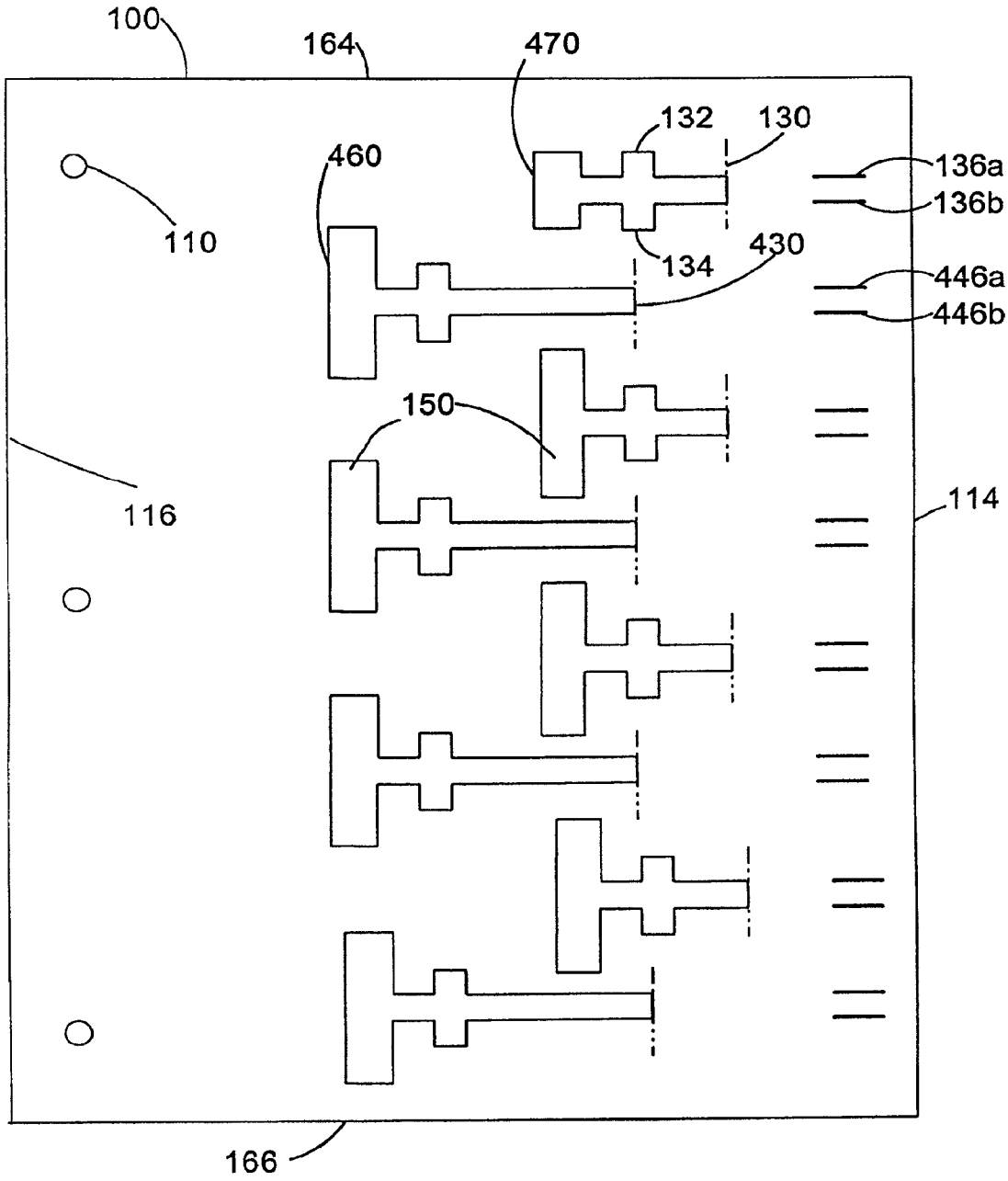
FIG. 4 is an illustration of a different embodiment of divider sheet material having printable pop-out index tabs.

FIG. 4 is an illustration of a divider sheet material 100 of the machine-printable index tab assembly 10 having a different arrangement and shape of the print index tabs 120. More index tabs 120 may be placed on a divider sheet material 100 by changing the size of the index tabs or by staggering the folds 130 as shown in FIG. 4. FIG. 4 illustrates the staggered arrangement whereby alternate index tabs will have different dimensions between the fold 130 and the edge of the divider sheet material 100. Also, by staggering such as shown in FIG. 4, the distance between each index tab, i.e., the distance between index tab 470 and index tab 460 in a direction parallel to the edge 114 can be less than the distance between index tab 120 and index tab 140 in the same direction as shown in FIG. 2. Note that for those alternate pop-out index tabs 460 whose print region is located farther away from the edge 114 of the divider sheet material 110 from which the index tab 460 will extend, the distance from the fold 130 to the ears 132, 134 will be correspondingly greater than the index tabs 470 whose folds 130 are closer to the edge 114 of the divider sheet material 100. FIG. 4 represents several alternative arrangements of index tabs 120 on a divider sheet material 100; certainly it is contemplated that index tabs 120 may extend from more than one edge of the divider sheet and that index tabs 120 on a divider sheet material 100 need not be the same size as other index tabs 120 on the same sheet in any dimension. For instance, FIGS. 2A and 2B show that when deployed, the index tabs 120 will appear to be the same size; this need not be the case—FIG. 4 shows that some index tabs 460 may be larger to designate, for example, major divisions and some index tabs 470 on the same divider sheet material 100 may be smaller to designate sub-divisions. When deployed, index tab 470 in FIG. 4 has a smaller printable region and may designate a different kind of matter or issue.

Computer program code for carrying out operations to print the machine-printable, pop-out tabbed indexed dividers may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN), a wide area network (WAN), or the connection may be made to an external computer (for example, through the Internet using an Internet Service Provider), or even wirelessly.

Printing the machine-printable index tab assembly 10 is described below with reference to flowchart illustrations and/or block diagrams of methods, apparatus (systems) and computer program products according to the several disclosed embodiments. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a printer, such that the instructions, which execute via the processor of the computer or other programmable data processing apparatus, cause the printer to implement the functions/acts specified in the flowchart and/or block diagram block or blocks.

These computer program instructions may also be stored in a computer-readable medium that can direct a computer or other programmable data processing apparatus to function to print the machine-printable pop-out tabbed index dividers in a particular manner, such that the instructions stored in the computer-readable medium produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide processes for implementing the functions/acts specified in the flowchart and/or block diagram block or blocks.

Any combination of one or more computer usable or computer readable medium(s) may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CDROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device. The computer-usable medium may include a propagated data signal with the computer-usable program code embodied therewith, either in baseband or as part of a carrier wave. The computer usable program code may be transmitted using any appropriate medium, including but not limited to wireless, wireline, optical fiber cable, RF, etc.

Each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Computer programs, templates and graphical user interfaces are provided and/or incorporated into a word processing program to provide application instructions to print the index tabs 120. Templates of the machine-printable index tab assembly 10 may be presented to the user on a computer display unit. Each template may provide the dimensions of the divider sheet material 100 and the number and location of the index tabs 120 and the printable regions 150. A user can then select a particular template with a mouse or other user input device and the selected template will be displayed on a graphical user interface so that a user merely key enters the letters or symbols to be printed on one or more index tabs 120 per divider sheet material 100. It is further contemplated that the user need only enter the alphanumeric characters, e.g., letters or symbols, and the computer program instructions will rotate or otherwise position the input characters so they are printed correctly. In other words, typically words are entered horizontally but when deployed the printed entry will appear vertical on the index tab 120. Computer program instructions may automatically rotate the entry and/or adjust the pitch size so that the entry fits within the printable region 150 and is correctly oriented. Alternatively, the computer program may offer a user the capability of changing the orientation of the alphanumeric text in the printable region of the index tab. Instructions are also provided for placement of the divider sheet material 100 in a printer so that the printable region 150 is exposed to the ink or the print matrix, etc.

Figure 5:
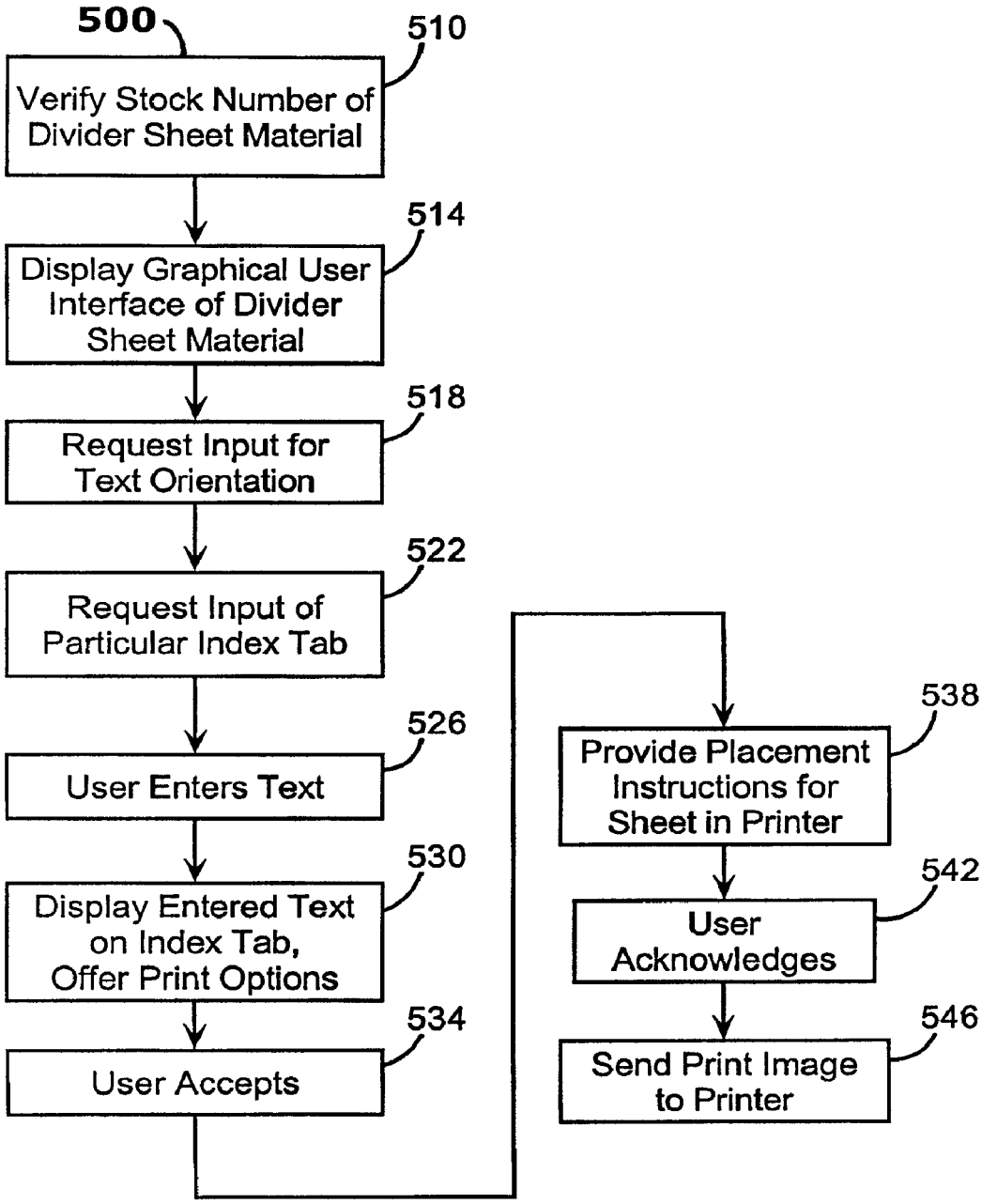
FIG. 5 is a simplified flow chart of a computerized process that interacts with a user to print the index tab assembly.

Viewing FIG. 5, a computer will present a graphical user interface in step 510 that requests input from a user to verify a label stock number. For instance, the arrangement of index tabs on a divider sheet material as shown in FIG. 1 will have a different stock number than the divider sheet material having the arrangement of index tabs as shown in FIG. 4. Upon entry of the stock number of the machine-printable index tab assembly 10, the computer program in step 514 retrieves a template of the machine-printable index tab assembly 10 corresponding to the stock number and presents the template on a graphical user interface illustrating the divider sheet material with the arrangement of index tabs. The computer program may optionally request input from the user at step 518 for the desired orientation of the final printed index tab 120, e.g., will the top of text be oriented toward binding or away from binding? In step 522, the user will be directed to input the particular index tab that is to be printed, such as the bottom tab with the label CLAIMS as shown in FIGS. 3A and 3B.

In step 526, the user will be requested to enter the alphanumeric characters or text that will actually be printed in the printable region of the index tab. In step 530, the computer program automatically verifies that the text entered by the user will fit into the printable region and/or offer options for scaling font size and/or introducing line breaks. Preferably, in step 530, the computer program will display, in real time, a rendering of the text in the printable region of the index tab when deployed as she/he enters the text.

When the user indicates completion in step 534, the computer software in step 538 provides instructions to the user to position and orient the divider sheet material in the printer for correct printing. A user acknowledges the instructions in step 542, and in step 546 the computer program creates a printable image with the text positioned correctly within the printable area of the chosen tab number and sends the image to the printer for printing.

Optionally, computer program instructions can present a graphical user interface illustrating numbered input printable regions for all the index tabs available in the selected label stock and the user can enter the text for all index tabs at once. The computer program instructions then assemble a printable image for each successive page and print all pages of the divider sheet material in one operation. The graphical user interface may provide a checkbox so the user can select to print the entered text on one or more or all the index tabs on one divider sheet material as opposed to the normal configuration of printing them successively, one tab per sheet.

The terminology used herein is for the purpose of describing particular embodiments only and is not intended to be limiting of the invention. The directions of the dimensions have been used as vertical to represent the longer dimension of the divider sheet material having a top edge and a bottom or lower edge and horizontal to represent the shorter dimension of the sheet material as having a right edge and a left edge, as in a portrait orientation. Index tabs may be employed along any edge. The sheet material, moreover, may be used in a landscape orientation. Thus, the terms "horizontal" and "vertical" and "reverse" and "obverse" will change accordingly and the embodiments are not intended to represent the index tabs as being used only in the portrait orientation along the right edge and printed on the reverse as shown in FIGS. 1, 2A and 2B. As used herein, the singular forms "a," "an" and "the" are intended to include the plural forms as well, unless the context clearly indicates otherwise. It will be further understood that the terms "comprises" and/or "comprising," when used in this specification, specify the presence of the stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A machine-printable index tab assembly, comprising:

a sheet material;

two or more pop-out index tabs integral with the sheet material, each pop-out index tab having a fold, each pop-out index tab perforated along its perimeter except at the fold, each pop-out index tab having a printable region opposite the fold, each pop-out index tab having at least one ear between the fold and the printable region, and at least one of the two or more pop-out index tabs is a different size than one or more other pop-out index tabs on the sheet material;

at least one slit in and positioned near an edge of the sheet material, each slit substantially a same length as and corresponding to at least one ear;

a carrier layer attached to a side of the sheet material opposite to a side from which the two or more pop-out index tabs pop-out;

wherein each pop-out index tab is releasable from the sheet material except at the fold and is rotatable along the fold, and the at least one ear is insertible into its corresponding at least one slit, and the printable region is extensible beyond the edge of the sheet material as an index tab; and wherein the at least one pop-out index tab of the different size has a greater distance between its fold and its corresponding ear than others of the at least one or more pop-out index tabs.

2. The machine-printable index tab assembly of claim 1, wherein the two or more pop-out index tabs are releasable from the carrier layer.

3. The machine-printable index tab assembly of claim 1, wherein the two or more pop-out index tabs are equally spaced along a dimension of the sheet material.

4. The machine-printable index tab assembly of claim 1 wherein the printable region of at least one of the pop-out index tabs of the different size is larger than others of the at least the two or more pop-out index tabs.

5. A machine-printable index tab assembly, comprising:

a sheet material;

one or more pop-out index tabs integral with the sheet material, each pop-out index tab having a fold, each pop-out index tab perforated along its perimeter except at the fold, each pop-out index tab having a printable region opposite the fold, each pop-out index tab having at least one ear between the fold and the printable region;

at least one slit in and positioned near an edge of the sheet material, each slit substantially a same length as and corresponding to at least one ear;

a carrier layer attached to a side of the sheet material opposite to a side from which the one or more pop-out index tabs pop-out, the carrier layer having an opening at the printable region and the printable region is exposed through the opening on the carrier layer;

wherein each pop-out index tab is releasable from the sheet material except at the fold and is rotatable along the fold, and the at least one ear is insertible into its corresponding at least one slit, and the printable region is extensible beyond the edge of the sheet material as an index tab.

6. The machine-printable index tab assembly of claim 5, wherein the one or more pop-out index tabs are releasable from the carrier layer.

7. The machine-printable index tab assembly of claim 5, wherein the one or more pop-out index tabs are equally spaced along a dimension of the sheet material.

* * * * *